United States Patent [19]

Owner-Petersen et al.

[11] 4,186,297

[45] Jan. 29, 1980

[54] SUNLIGHT CALCULATOR

[75] Inventors: Paul Owner-Petersen, Gentofte, Denmark; Kjeld B. Lund-Hansen, Krajbjergvej 3, Sködstrup, Denmark

[73] Assignee: Kjeld Balslev Lund-Hansen, Denmark

[21] Appl. No.: 888,650

[22] Filed: Mar. 21, 1978

[30] Foreign Application Priority Data

Mar. 22, 1977 [GB] United Kingdom ..... 12104/77

[51] Int. Cl.[2] ..... G06C 3/00

[52] U.S. Cl. ..... 235/89 R; 235/70 A; 235/85 R

[58] Field of Search ..... 235/89 R, 85 R, 70 A

[56] References Cited

U.S. PATENT DOCUMENTS

| | | | |
|---|---|---|---|
| 2,494,536 | 1/1950 | Atwood | 235/89 R |
| 2,512,387 | 6/1950 | Sands | 235/89 R |
| 3,026,031 | 3/1962 | Jones | 235/89 R |
| 3,266,721 | 8/1966 | Barron | 235/89 R |
| 3,341,117 | 9/1967 | Painter | 235/89 R |
| 3,577,854 | 5/1971 | Felix | 235/89 R |

*Primary Examiner*—Stephen J. Tomsky
*Attorney, Agent, or Firm*—Craig and Antonelli

[57] ABSTRACT

A calculator for sunlight effect having a base portion which holds two orthogonal plate slides of which one is transparent and provided with a double curve system enabling plotting of any day/hour combination, the curve system, being characteristic for a specific latitude, and this slide being positionable according to a relevant facade direction. On the base portion underneath the slide is printed a curve system indicative of the heating effect of the sun for any point in the double curve system. The other slide has a pointer curve which, when brought to register with any point of the double curve system, causes the other slide to assume a position indicative of the inclination of the shadow by the particular combination of parameters, and the other slide forms together with the base portion and further slides a slide rule calculator enabling a direct determination of the vertical shadow on a window as caused by an overhanging sunshade structure.

19 Claims, 8 Drawing Figures

Figure 1:
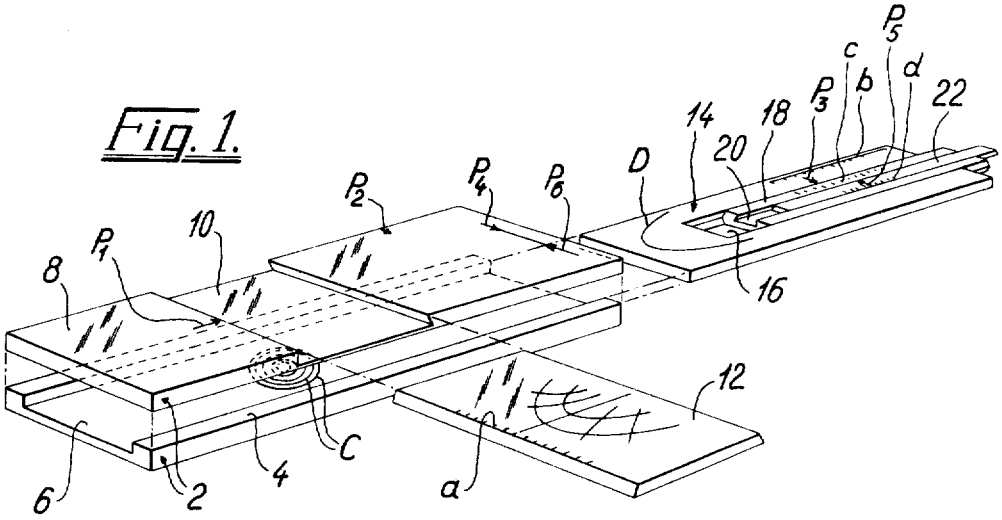

Fig. 7.
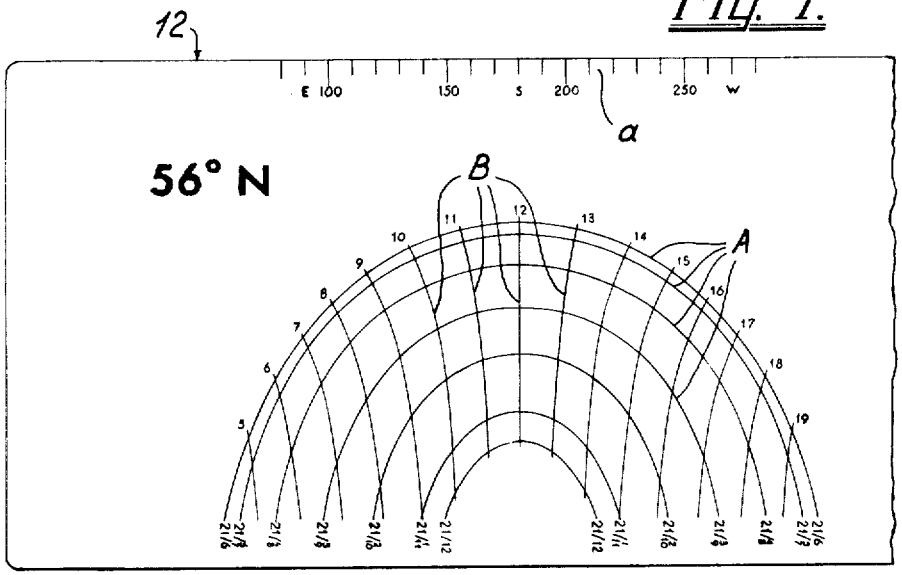
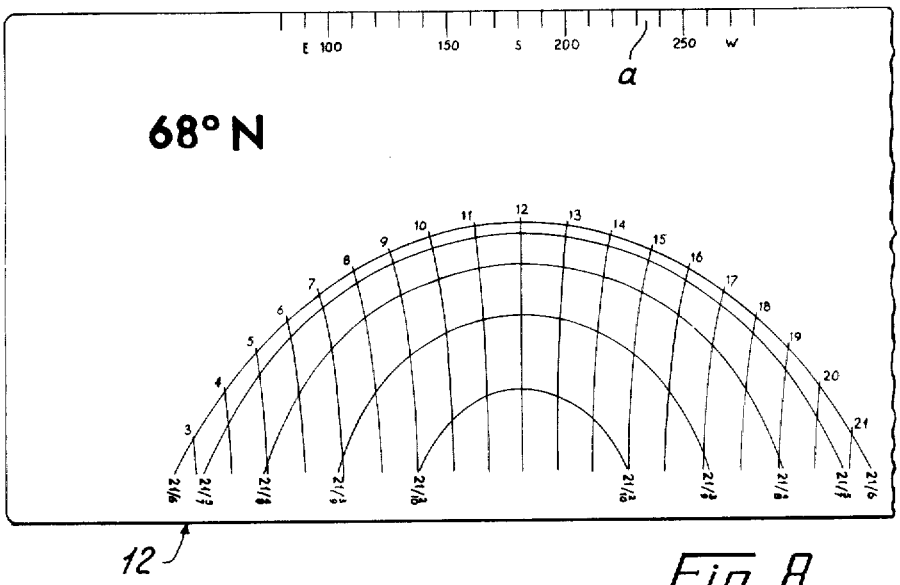
Fig. 8.

SUNLIGHT CALCULATOR

This invention relates to auxiliaries for indicating the effect of the sun light on surfaces, primarily building facades, depending of the various parameters determining this effect. The sunlight on a given surface (or behind a glass surface) gives rise to a heating effect which should be taken into account when the heating/ventilation/sun shading systems of a building are worked out, while the light itself may require suitably designed sun shading for avoiding undesirable direct sunshine in a room.

Both the heating effect and the direction of the sunlight on a given surface depend on several parameters:

(1) The geographical latitude.

(2) The geographical direction of the facade surface.

(3) The date of the year.

(4) The time of the date.

Still a further parameter is the inclination of the surface, but it is here generally presumed that vertical surfaces are in question; however remarks as to inclined surfaces will be given below.

In order to facilitate the relevant calculations numerous tables have been developed each including a number of values all based on one of the above-noted four parameters and indicating the relationship between the other parameters in terms of either the sun heat generation per square unit of the facade or of design conditions for sun shading structures, but it will be understood that for reading a detailed picture of the respective effect by any combination of the parameters it would be necessary to have at one's disposal an almost infinite number of tables.

It is the primary purpose of this invention to provide a simple calculator enabling the user to rapidly find the relevant character (heat generation and/or direction) of the sun light by any combination of the above-noted parameters, and according to the invention there is provided a calculator comprising a base plate having a reading area and guiding means for displaceably holding a plate slide extending over the reading area and being linearly displaceable relative thereto along an equidistant adjustment scale representing the geographic direction of the facade, the plate slide by itself representing a specific latitude range and having printed thereon a correspondingly specific curve system of mutually intersecting curves which in a coordinate system represent various hours of the day and various seasons or dates of the year, respectively, in such a manner that the location of the points of intersection as seen in the displacing direction of the plate slide—here defined as the ordinate direction of said coordinate system—refers to the azimuth angle of the sun by the same equidistant scale as said adjustment scale, while the location of the points of intersection in the abscissa direction of the coordinate system, i.e. in the direction transverse to the direction of displacement of the plate slide, refers to a function of the sun altitude, the reading area being provided with a marking referring to the relevant effect of the radiation as defined by the position of any of intersection points in any characteristic position of plate slide. In practice, when the curve system of the plate slide refers to the geographical latitude, it will be sufficient to use a specific slide for calculations relating to a geographic area of a considerable size, e.g. within a range of 2–5 degrees of latitude, and for other latitudes may be used similar respective plate slides having their curve systems designed accordingly.

When the relevant plate slide is transparent and is adjusted to its position corresponding to the geographic direction of the facade or other surface in question each point in the curve system, designating a day/hour combination, will assume a well defined position in a coordinate system of the reading area of the base plate, and in this system (whether visualized or not) the ordinate of the point will represent the sun azimuth relative to the facade, namely, the absolute azimuth as defined by the curve system corrected by the facade direction as given by the setting of the plate slide, while the abscissa of the point represents the sun altitude. These two parameters, namely, the sun altitude and the relative sun azimuth, are decisive for both the heating and the shading effects on the facade, so the reading area may be marked to show the relevant values either in a direct manner or by way of a pointer marking on a further slide which is movable to make the pointer marking coincide with the selected point and thereby to show the relevant value on a separate scale.

As far as the heating effect or heat transmission is concerned it will normally be fully sufficient to provide the reading area with a printed curve system with curves representing the various degrees of heating effect specified, e.g. as heat transmission through a square unit of a double glass window. The curves may be printed on interchangeable carriers to be mounted in the reading area, whereby the indicator curve system may be designed to suit any specific character of the surface shined upon by the sun and even to suit any specific inclination of the surface, e.g. a solar collector panel.

An important aspect of the invention is the use of the base portion and plate slide in connection with further slide means for calculating details as to a sun shading arrangement. Normally a sun shading structure mounted outside and above a window should be designed with an outhanging length in accordance with a preferred compromise between optimal shading at all days of the year, based on knowledge of the height of the window and the percentage of the window height wanted to be sun shaded at any time of any day of the year. An important magnitude in this connection is the inclination of the shadow, i.e. the inclination of a plane containing the center of the sun and a horizontal line on the facade. Also such calculations may be based on tables referring to the daily and hourly variation of the altitude and the azimuth of the sun, but the calculations are difficult to make.

Now, in connection with the invention it has been found that the curve system on the slide may be designed in such a manner, by logarithmic anomaly of the abscissa, that an indicator slide having a pointer marking located in the reading area is displaceable in the direction of the abscissa to enable slide rule calculations based on the sun altitude, which is of course a major parameter as far as sun shading is concerned. However, shadow calculations based on the sun altitude will be correct only when the sun is perpendicular to the facade, and generally the relevant factor will be the inclination of the shadow as referred to above. For any given altitude of the sun the inclination of the shadow will vary with the angular deviation of the relative azimuth from the facade direction (the latter being the horizontal direction of the normal from the facade), and according to a very important aspect of the invention the pointer marking may be a curve which in any point by any ordinate serves to correct the position of the indicator slide according to the deviation in such a manner that the slide is set in direct accordance with the inclination of the shadow rather than with the altitude of the sun. For this reason it is possible to combine the indicator slide with further slide rule elements enabling an immediate calculation or reading of values referring to the shading effect of a sun shade structure, even without any need of the calculator showing the shadow inclination itself.

Thus the calculator may be of overall slide rule character, and it is very easy, therefore, to determine the effects of a change of any one of the several parameters.

Figure 2:
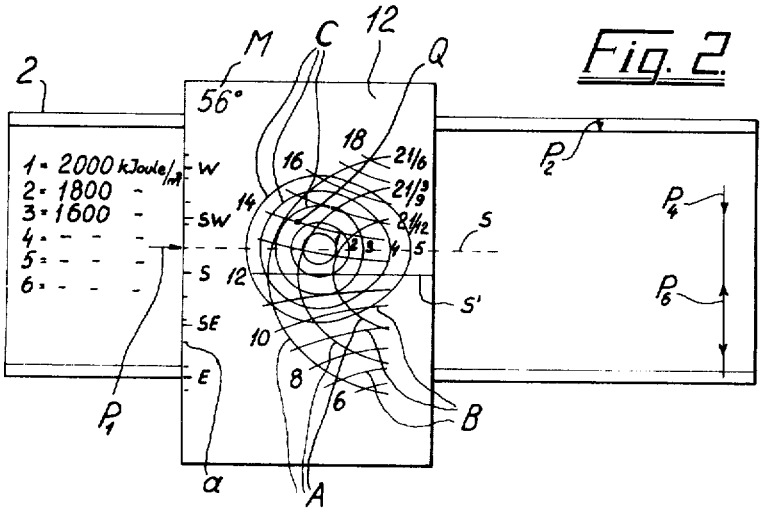
Figure 3:
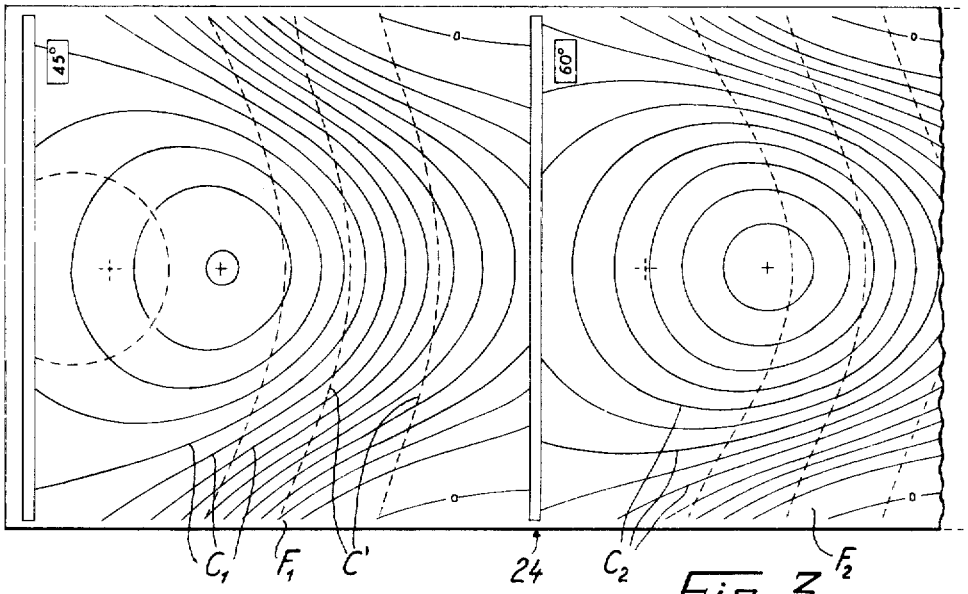
Figure 4:
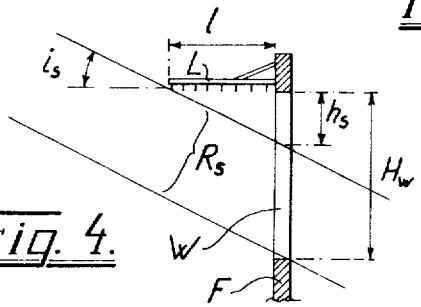
Figure 5:
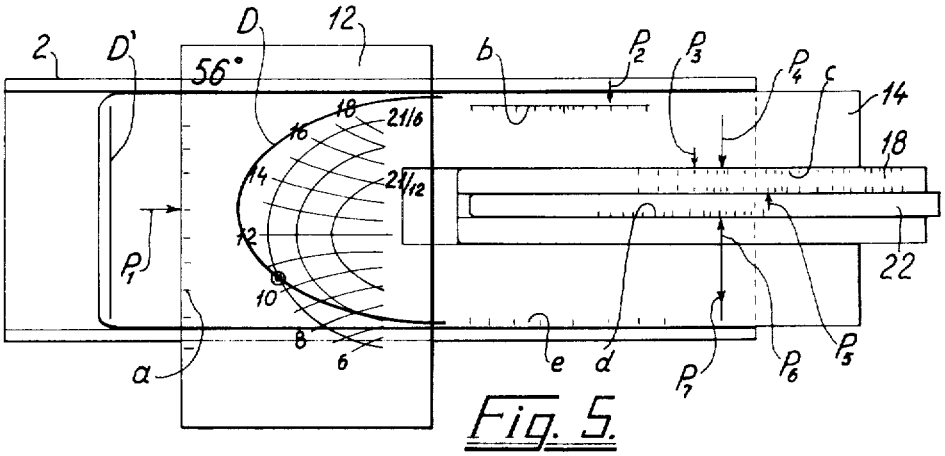
Figure 6:
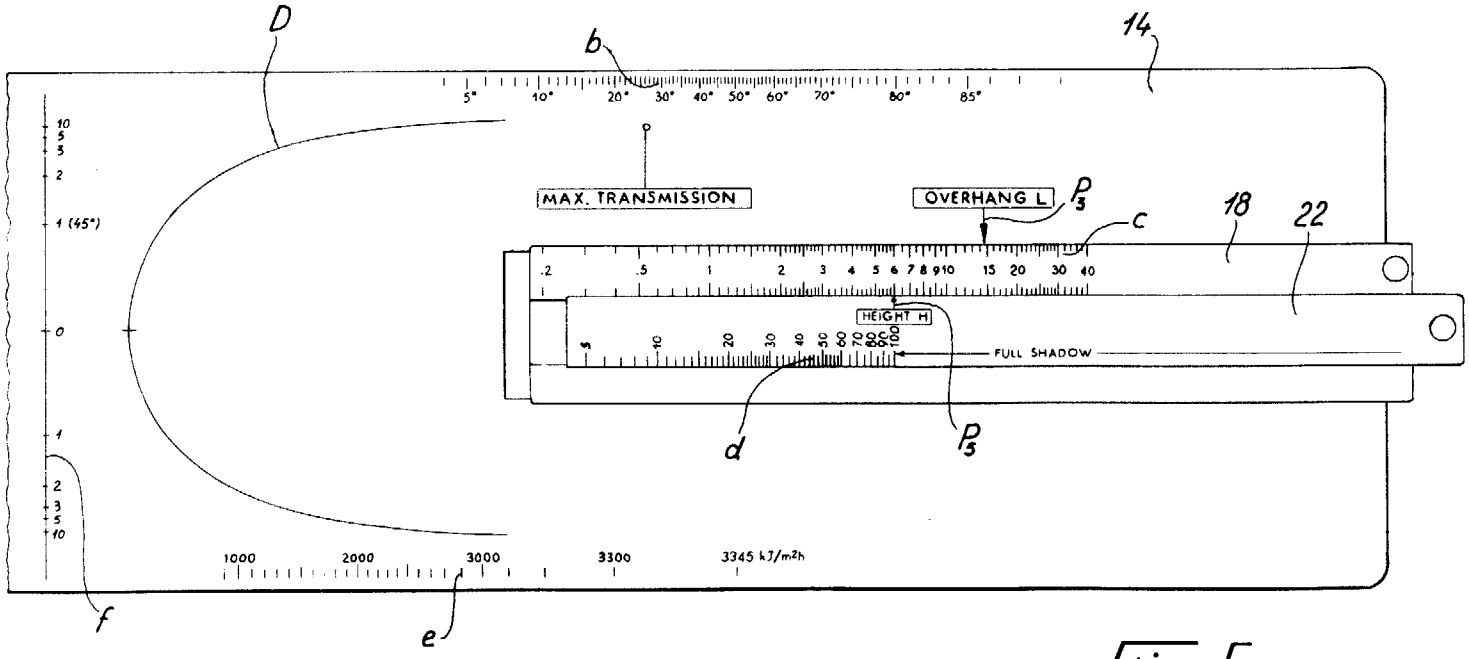

Further aspects and details of the invention will appear from the following description with reference to the accompanying drawing, in which:

FIG. 1 is an exploded view of a calculator according to the invention,

FIG. 2 is a plan view thereof as used for determining the heating effect of the sunlight, FIG. 3 is a plan view of an auxiliary slide for the same purpose, FIG. 4 is a schematic illustration of a sun shaded window, FIG. 5 is a plan view of the calculator as used for calculating the shade effect, FIG. 6 is a plan view of the indicator slide, and FIGS. 7 and 8 are plan views of two authentic plate slides.

As shown in FIG. 1 the calculator according to a preferred embodiment of the invention is multi-slide rule comprising a base portion or plate generally designated by the reference numeral 2 made of a bottom piece 4 having a longitudinal groove 6 and a top piece 8 made of transparent material and having a transverse groove 10 for slidingly receiving a plate-shaped cross slide 12 of transparent material. When the parts 4 and 8 are assembled, an indicator slide generally designated by the reference numeral 14 is receivable in the groove 6 with the indicator slide 14 having a longitudinal slot 16 in which is slidingly received a further slide 18 which, in turn, is provided with a groove 20 for receiving another slide 22.

On the cross slide 12 is printed a system of curves shown more clearly in FIG. 2 and comprising a first set of approximately half-circular or parabolic curves A representing—and marked with—various days of the year and a second set of curves B crossing the curves A representing and marked with various hours of the day. Moreover the cross slide 12 has along its left edge a scale a cooperating with a pointer $P_1$ on the base portion 2, this scale a referring to the geographic direction of the facade, i.e. the horizontal direction of a line normal to the facade. As will be observed the scale a ranges from west through south to east. The cross slide 12 itself is marked with an indication M of the geographical latitude, to which the curves A and B belong, i.e. individual cross slides 12 may be used for other latitudes or latitude ranges.

When the relevant cross slide 12, e.g. representing 56° northern latitude, is inserted in groove 10 and adjusted to the correct position as given by scale a and arrow $P_1$, the remaining two basic parameters will be defined by the curve sets A and B such that the point of intersection between the relevant curves will be representative, by its location relative to the base portion 2, of the specific combination of all four parameters. As an example is in FIG. 2 marked a point Q which is indicative of the sun position relative to a facade facing 200° on northern latitude 56°, at 2 p.m. or 1400 hours midways between 21st June and either 21st March or 21st September, i.e. on ca. 6th May or August. The curve system, of course, may be still more detailed for higher accuracy.

The surface of the cross slide 12 can be regarded as a coordinate system with the scale a as the ordinate and a transverse middle line s as the abscissa. The ordinate represents the azimuth of the sun, located in the south azimuth and with equidistant calibration, while the abscissa represents the altitude of the sun on a logarithmic scale which need not be printed. In the curve system B, the middle or symmetry line coinciding with the abscissa s' corresponds to noon, and generally the entire curve system A,B is symmetrical about this line. Each point in the system represents a sun position of a certain altitude determining the abscissa of the point and a certain astronomic azimuth determining the ordinate of the point in full accordance with the calibration of the ordinate scale a. When the cross slide 12 is set according to the direction of a pure south facade the symmetry line s' will coincide with the pointer $P_1$ as located on a transverse middle line s of the reading area on the base plate 2 underneath the generally transparent cross slide 12. Adjustment of the slide position will not affect the abscissa positions of the curve points, but it will be noted that an adjustment to a facade direction other than south will result in the curve system being non-symmetric about the line s, which forms a fixed abscissa axis in a corresponding coordinate system of said reading area on the base plate 2. By moving the cross slide 12 from the south position S to any other position all the ordinates as counted from the s-line will be reduced or increased according to the displacement of the slide, this resulting in the ordinates in the coordinate system s,a being adjusted to represent the relative azimuth of the sun with respect to the facade in question, and it is of course this relative azimuth which is important for calculating the sun effect on the facade.

A further curve system C is printed on the reading area of the base portion 2 so as to be visible through the cross slide 12. This curve system C is designed so as to form a reference basis for enabling a reading of the heating effect of the sun rays for each point in the curve system A,B and thus for each set of the four main parameters. Generally the curves of the curve system C are closed and symmetric about the line s, and each represents a certain amount of KJoule/m$^2$/h; they may be marked correspondingly, but in FIG. 2 they are provided with reference numbers 1–5 which are also located on the left end top side of base portion 2. Each point of the curves of the curve system C represents the heating effect resulting from a specific combination of sun altitude and relative azimuth, regardless of how this combination is brought about by any set of the four parameters. The curves of the curve system C preferably refer to the inside heat generation of the sun rays through square units of window portions of the facade. From the following example it will be apparent that the point designated Q is indicative of a heat generation of some 1700 KJoule/m$^2$ (this figure not being authentic). It will be observed that at the date in question the heat generation will reach a maximum at about 1:30 p.m. or 1330 hours. A maximum at 12 o'clock is reached only when the facade is facing straight south.

FIG. 3 illustrates an auxiliary plate slide generally designated by the reference numeral 24 which is insertable into the groove 6 of the base plate 2 instead of the slide 14 illustrated in FIG. 1. The slide 24 has two rectangular sub areas $F_1$ and $F_2$ each being adapted to be placed underneath the cross slide 12 and each having a curve system $C_1$ and $C_2$, respectively, of which the selected system will replace the curve system C as a reading basis. Each sub area refers, by printed information or otherwise, to specific circumstances such as heat transmission through triple pane windows or heating effect on surfaces of specific materials, the respective curve systems $C_1$, $C_2$ being designed accordingly. An important possibility is that each sub area may represent a specific inclination of the surface in question, whereby the heating effect, e.g. on solar collector panels will be readable. Of course, similar carriers with any number of curve sets may be provided if desired.

The curve systems C, $C_1$, $C_2$ represent the heating effect of the direct sunlight, but supplementary curves C' may be added to enable reading of the effect of the so-called diffused or secondary radiation.

Instead of providing separate carriers for the curve systems C, $C_1$, $C_2$, e.g. for different surface materials or window types it may be possible to select a few typical standards and make use of transformation scales, e.g. printed on the rear side of the calculator, for enabling comparisons between the relevant value pertaining to the standard and another material, respectively.

The indicator slide 14 illustrated in FIG. 1 is used for calculations relating to the shading effect of a sunshade structure mounted overhead a window. To facilitate the understanding reference is first made to FIG. 4, in which is schematically shown a cross sectional view of a window W in a wall F. From the top edge of the window projects a horizontal sun shade L having the overhang length l. The height of the window is designated $H_w$. A sun ray beam $R_s$ passes through the window W, whereby the upper height or shaded window portion designated $h_s$ of the window W is left in shadow. The inclination of the sun ray beam $R_s$ direction relative to the horizontal direction is shown by the angle shadow inclination $i_s$. This angle $i_s$ is the "shadow inclination" and is in fact the only sun parameter defining the relation between the height $H_w$ of the window W and the shaded window portion $h_s$ thereof.

The shadow inclination angle $i_s$ is not in any direct manner given by either the relative azimuth or the absolute altitude of the sun, but of course by any actual combination of these values. It will be appreciated that each point (Q) of the curve system A,B on the cross slide 12 as set in accordance with the facade direction represents such a combination, and it has been found possible to provide the left-hand end of the indicator slide 14 with a pointer curve D which, when placed so as to coincide with any selected point Q, will make the indicator slide 14 assume a position indicative of the particular shadow inclination angle $i_s$, whereby further trigonometric calculations as to the extension of the shaded window portion $h_s$ can easily be made by means of a slide rule system.

The curve D is shaped in such a manner that the front end thereof is located on the transverse line s to thereby correspond to the relative sun azimuth perpendicular to the facade in question, whereby the shadow inclination angle $i_s$ is identical with the so-called angle of incidence of the sun rays on the facade, as given by the altitude of the sun, while for lower and higher azimuth angles the points of the curve D for any ordinate are located so as to represent the correction factor necessary for converting the angle of incidence into the shadow inclination of the shadow, $i_s$. As a result, whenever the indicator slide 14 is adjusted to coincidence between the curve D and a selected four parameter point of the cross slide 12 the position of the indicator slide 14 relative to the base 2 plate will be indicative of the inclination of the shadow, which may be represented by a scale b on the indicator slide 14 and readable at a pointer $P_2$ on the base plate, or of course by an inverted pointer and scale arrangement.

The scale b is of such anomaly as to be usable in connection with slide rule calculations for trigonometric functions relating to the shaded window portion $h_s$ on the window W as a function of the overhang length l of the sunshade L and the shadow inclination angle $i_s$.

Thus, the indicator slide 14 may be provided with a scale c cooperating with a pointer $P_4$ on the transparent top plate of the base plate structure, see FIGS. 1 and 5, whereby the height of the shadow or shaded window portion $h_s$, will be readable for any specific overhang length l of the sun shade, on which the scale c is based. However, because of the anomaly of the system the scale c may be provided on a sub slide 18 and cooperate with a pointer $P_3$ on the indicator slide such that the sub slide can be set to represent any desired overhang length l, whereafter the shadow height or shaded window portion $h_s$ for that overhang length will be readable by the pointer $P_4$.

On a further sub slide 22 slidingly held by the first sub slide 18 is provided a pointer $P_5$ cooperating with the scale c to indicate the height $H_w$ of the window W on that scale, and further having a scale d which is readable by a pointer $P_6$ on the top plate of the base plate, the scale d representing the percentage of the shaded window portion $h_s$ of the entire window height $H_w$. This scale d, of course, stops at 100%, as beyond that end of the scale the entire window height $H_w$ will be fully shaded.

If the overhang length l and the window height $H_w$ are already known and the sub slides 18 and 22 are set accordingly in the indicator slide 14, then the results as read at the pointer $P_6$ (shade percentage on the window) will still be correct if the entire slide system 14,18,22 is moved to coincide between the pointer curve D and any other selected four parameter point of the cross slide 12. Generally it will be appreciated that it is easily possible to change any of the total amount of parameters and observe the consequences to other of the parameters. The parameters are combinable in billions of ways, but the simple calculator according to the invention can deal with all relevant combinations.

As known to those skilled in the art the inclination of the shadow is substantially unchanged throughout the hours of the days of the equinox, i.e. of the 21st of March and September, respectively, and accordingly the curve D should be similar to the curve B representing these dates of the year so as to coincide therewith when the cross slide 12 assumes its south position and the pointer $P_2$ indicates the particular shadow inclination on the scale b. The angle is 34° on the latitude 56°, given as it is be its complementary to the latitude with respect to 90°. This fact conditions that the curve system A,B on different cross slides 12 should be placed generally longer to the left the smaller the latitude is. This is clearly illustrated in FIGS. 7 and 8 wherein authentic curve systems A,B are shown for latitudes of 56° and 68°, respectively.

Since as mentioned the abscissa of the coordinate system of the cross slide 12 represents the altitude of the sun the calculator could be provided with a scale indicative of the altitude, either as a scale printed direct along the line s or a scale extending along the indicator slide 14 to be indicative of the slide position in response to a vertical pointer line D' near the curve D being set to coincide with the four parameter points in question. However, an indication of the altitude may be of little practical interest, so in practice it is preferred to make use of such a scale, designated e in FIG. 6, which is calibrated in terms of heating effect per square unit on a surface perpendicular to the sun radiation.

Also shown in FIG. 6 is a vertical scale f printed on the indicator slide near the curve D. The scale f represents the length of the side shadow produced on the facade by a vertical shade plate projecting one length unit perpendicularly from the facade. The side shadow will be determined solely by the relative azimuth of the sun, and since this is the ordinates of the various four parameter points on the cross slide 12 the side shadow factor is easily found by moving the indicator slide 14 to coincide with the scale f and the parameter point in question and then read the result on the scale f.

What is claimed is:

1. A calculator for calculating effects of sun radiation on a facade in dependence upon an hour of a day, a date of a year, a geographic direction of the facade and the latitude, comprising a base plate having a reading area, a cross slide, means for holding the cross slide at the base so as to extend over said reading area and for enabling a linear displacement of the cross slide relative to the base plate, a first scale arranged on one of the base plate and cross slide, said first scale being divided into equidistant increments representing the geographic direction of the facade, said cross slide having a specific latitude range indicated thereon and a predetermined curve system of mutually intersecting curves which, in a coordinate system, respectively represent various hours of the day and various seasons or dates of the year, the curve system being arranged on the cross slide in such a manner that the location of points of intersection of the intersecting curves in an ordinate direction of said coordinate system indicating an azimuth angle of the sun on the first scale, with the points of intersection in an abscissa direction of the coordinate system indicating a function of the sun altitude, and wherein further indicia are provided in the reading area of the base plate for enabling a reading of relevant effects of the sun radiation as defined by a position of any of the intersection points of the intersecting curves in any characteristic position of said cross slide relative to the base plate.

2. A calculator according to claim 1, wherein at least two interchangeable cross slides are provided, each cross slide having a curve system thereon corresponding to different respective latitudes or latitude ranges.

3. A calculator according to one of claims 1 or 2, wherein said further indicia include a further curve system for indicating one of the heating effect or the heat transmission of the sun light on or through a square unit of the facade.

4. A calculator according to claim 1, wherein at least two interchangeable carriers are provided, each carrier having a further curve system corresponding to a different inclination of the facade or other light receiving surface.

5. A calculator according to claim 1, further comprising an indicator slide slidably received in the base plate so as to be displaceable in a direction transverse to the displacement direction of the cross slide in accordance with an altitude of the sun, said further indicia including a pointer curve representing an abscissa correction required for transforming by any ordinate the sun altitude into a shadow inclination angle such that when the indicator slide is adjusted to a position of coincidence between a predetermined parameter point on the cross slide, the pointer curve indicates the shadow inclination for the predetermined parameter.

6. A calculator according to claim 5, wherein the cross slide includes a logarithmic scale extending in the abscissa direction of the coordinate system, at least one additional slide is displaceably mounted relative to the indicator slide so as to form a slide rule, and wherein indicia are provided on the indicator slide and the at least one additional slide for indicating a relationship between an overhang length of a sunshade above a window and the shadow height for the overhang length on the window in accordance with a shadow inclination angle determined by a relative position of the at least one additional scale with respect to the indicator slide and with respect to the base plate.

7. A calculator according to claim 6, wherein the indicia provided on the indicator slide and the at least one additional slide includes at least one additional scale for indicating a shadow inclination angle, said at least one additional scale extending in a displacement direction of the indicator slide.

8. A calculator according to one of claims 5 or 6, wherein a pointer line extending in the ordinate direction of the coordinate system is arranged on the indicator slide, said pointer line being cooperable with the indicia provided in the reading area on the base plate for indicating the heating effect of the sun radiation on a surface perpendicular to the radiation in accordance with the sun altitude as represented by a positioning of the indicator slide and coincidence between said pointer line and any selected parameter point on the cross slide.

9. A calculator according to claim 6, wherein the at least one additional slide is formed as an auxiliary slide displaceably mounted in the indicator slide, the auxiliary slide including a scale for indicating an overhang length for specific sunshades, a reader mark is provided on the indicator slide for cooperation with said last-mentioned scale for showing the overhang length of predetermined sunshades, and wherein a further reader mark is provided on the base plate, said further reader mark being cooperable with said last-mentioned for showing a vertical dimension of the shadow of the predetermined sun shade.

10. A calculator according to claim 9, wherein a further additional slide is provided and formed as a second auxiliary slide displaceably mounted in the first auxiliary slide, said second auxiliary slide including an indicator means cooperable with the scale on the first auxiliary slide for providing an indication of the height of a shaded window and a scale providing values reflecting a shaded percentage of the window height, and a further indicator means provided on the base plate and cooperable with the scale on the second auxiliary slide for indicating the shaded percentage of the window height for predetermined parameters.

11. A calculator according to one of claims 1, 2, 5, 6, 9, or 10, wherein another scale is provided in the reading area extending in an ordinate direction, said last-mentioned scale being calibrated to indicate, as a function of the sun azimuth, a horizontal dimension of a side shadow on a facade as created by a vertical screen projecting a length unit perpendicularly from the facade.

12. A calculator according to claim 3, wherein the further curve system is arranged on a carrier plate removably mounted in the reading area of the base plate.

13. A calculator according to claim 1, further comprising an indicator slide means displaceably guided in the base plate in a direction transverse to the cross slide for enabling a calculation of a shading effect of a sun shade structure mounted over a window, a first scale arranged on one of the indicator slide means or base plate for providing an indication of a shaded portion as a function of an overhang length of the sun shade structure, and an index means provided on the other of the indicator slide means or base plate cooperable with the first scale so as to provide an indication of an inclination of a shadow cast by the sun shade structure for respective intersecting points of the intersecting curves of the curve system.

14. A calculator according to claim 13, further comprising an auxiliary slide member displaceably guided in the indicator slide means, a second scale arranged on one of the auxiliary slide member or the indicator slide means for indicating an overhang length of the sun shade structure, a further index means provided on the other of the auxiliary slide member or the indicator slide means for indexing the second scale, and wherein an indexing means is provided on the base plate and is cooperable with the second scale so as to enable a determination of a shaded portion of the window for respective overhang lengths of the sun shade structure.

15. A calculator according to claim 14, further comprising a second auxiliary slide member displaceably guided with respect to the indicator slide means and the first-mentioned auxilliary slide member, said second scale being arranged on the first-mentioned auxiliary slide member, and a further indexing means arranged on the second auxiliary slide member cooperable with the second scale so as to indicate a height of the window.

16. A calculator according to claim 15, further comprising a third scale provided on the second auxiliary slide member for indicating a percentage of a height of the window shaded by the sun shade structure, and another indexing means arranged on the base plate for cooperation with the third scale.

17. A calculator according to claim 16, further comprising a fourth scale arranged on the indicator slide means and calibrated in terms of a heating effect per square unit on a surface perpendicular to the sun radiation.

18. A calculator according to claim 17, further comprising a further scale arranged on the indicator slide means for determining a length of a side shadow produced on the facade by a vertical sun shade structure projecting one length unit perpendicularly from the facade.

19. A calculator according to claim 18, further comprising a pointer curve arranged on the indicator slide means, said pointer curve corresponding to a relative sun azimuth perpendicular to the facade.

* * * * *